United States Patent [19]

Takahashi et al.

[11] 4,374,727

[45] Feb. 22, 1983

[54] ELECTROSTATIC SORTING APPARATUS

[75] Inventors: Takeo Takahashi; Koichi Tabei, both of Kanagawa, Japan

[73] Assignee: Fuji Electric Co., Ltd., Kanagawa, Japan

[21] Appl. No.: 267,510

[22] Filed: May 27, 1981

[30] Foreign Application Priority Data

May 28, 1980 [JP] Japan ..... 55-71212
May 28, 1980 [JP] Japan ..... 55-71213

[51] Int. Cl.[3] ..... B03C 7/04; B03C 7/08
[52] U.S. Cl. ..... 209/127 B; 209/128
[58] Field of Search ..... 209/127 R, 127 B, 127 C, 209/128, 129, 130

[56] References Cited

U.S. PATENT DOCUMENTS 288,068 11/1883 Kuhnmünch ..... 209/129
2,247,596 7/1941 Boel ..... 209/130
2,306,105 12/1942 Grave ..... 209/128
4,116,822 9/1978 Webb ..... 209/127 R

FOREIGN PATENT DOCUMENTS 698593 11/1940 Fed. Rep. of Germany ..... 209/127
700976 12/1940 Fed. Rep. of Germany ... 209/127 C
726170 8/1942 Fed. Rep. of Germany ..... 209/128
2924048 5/1980 Fed. Rep. of Germany ..... 209/129
540671 12/1976 U.S.S.R. ..... 209/127 B
641999 6/1977 U.S.S.R. ..... 209/129
619213 8/1978 U.S.S.R. ..... 209/127 R
709174 1/1980 U.S.S.R. ..... 209/127 C

*Primary Examiner*—Ralph J. Hill
*Attorney, Agent, or Firm*—Sughrue, Mion, Zinn, MacPeak and Seas

[57] ABSTRACT

An electrostatic sorting apparatus having a multistage sorting unit including a plurality of sorting conveyor belts on sorting plates aligned vertically within a cover housing. Each sorting conveyor belt or plate has a trough-like channel formed thereon for sorting a mixture of insulating particles and conductive particles. The particles of the mixture are subjected to repeated cycles of charging with a negative polarity, being attracted to a high voltage electrode, discharging, and dropping downwardly into sorting and recovering hoppers. Thus, the particles are vigorously elevationally moved between the sorting conveyor belt or plate and the electrode up and down and are finally collected in hoppers. The particles are accordingly uniformly agitated in the channel of the sorting conveyor belt or plate. Thus, the mixture is separated into the hopper with an enhanced quality of compost while fine foreign materials mixed therewith are removed from the compost.

11 Claims, 16 Drawing Figures

ELECTROSTATIC SORTING APPARATUS

BACKGROUND OF THE INVENTION

The present invention relates to an electrostatic sorting apparatus. More particularly, the invention relates to an improved electrostatic sorting apparatus which sorts and refines different constituents in refuse utilizing the difference in electric properties of the constituents and the electrostatic (Coulomb) force induced in the various constituents.

Recently, certain constituents in municipal refuse have been reused as compost. For that purpose, from the raw municipal refuse are removed metals, glass, materials such as ceramics and pebbles, gravel, and plastics while the residual raw refuse is conveyed to a solid waste treatment plant, there finely pulverized are then subsequently conveyed to a composting plant for composting. In the composting plant, there are performed steps of preliminary fermentation and postmaturation fermentation to convert the raw refuse into completely matured compost followed by successive refinements such as vibration screening thereby to obtain a compost product. However, the compost produced through the postmaturation step contains a mixture of finely granulated pure compost solidified in lumps resulting from insufficient putrefaction and decomposition of the organic ingredients of the raw refuse, other ingredients resulting from insufficient putrefaction and decomposition, and foreign materials such glass, plastics, ceramics and pebbles and the like mixed with the refuse which were not successfully removed earlier. Of the mixture, large lumps of the ingredients resulting from insufficient putrefaction and decomposition and foreign materials of relatively large size can be classified and sorted through a vibration screen. However, finely pulverized foreign materials having a size on the order of several millimeters similar to the pure compost pass the screen mesh with the compost mixture. The foreign materials thus mixed in the compost through the classifying and sorting steps are present normally in a concentration of about several percent. However, this is not fully acceptable for agricultural use, and hence such contaminating materials should be removed as far as possible.

The principle of an electrostatic sorting operation is well known and a variety of modified electrostatic sorting apparatuses have been proposed and are in practical use in several industrial fields. A schematic view illustrating the principle of a representative electrostatic sorting plant used in refining ore or food powder is illustrated in FIG. 1. This electrostatic sorting plant has a rotary drum 1 forming a ground electrode, a corona discharge electrode 2 disposed at the side of the drum 1 to which a high voltage is applied, a feeder 3 with a supply hopper disposed above the drum 1 for supplying a mixture M to be sorted into the drum 1, and collecting hoppers 4 and 5 located under the drum 1. Reference numeral 6 indicater a scraper such as a brush in sliding contact with the periperal surface of the drum 1.

The principle of operation of such as electrostatic sorting plant is already well known, and hence only a brief description will be given here. In case that the mixture to be sorted is the forementioned compost, the mixture M includes insulating particles N, designated by small white circles, such as glass and plastics, and electroconductive particles O, designated by solid small black circles, of conductive compost containing a relatively high water content. A strong electric field is applied in the space between the corona discharge electrode 2 and the drum 1 with a corona current flowing toward the drum 1. When the compost containing foreign materials supplied onto the drum 1 from the feeder 3 reaches an area where there is a strong electric field, it is exposed to an ion shower. Due to the ion shower, the conductive particles O of the pure compost are drawn toward the drum 1 causing an ion discharge. Then, the conductive particles O are charged with the same polarity as the drum electrode by electrostatic induction. The conductive particles O of the pure compost are repelled from the cylindrical drum 1 due to the electrostatic force therebetween and resultantly fall forwardly toward the compost collecting hopper 5. On the other hand, the foreign materials such glass and plastics, the insulating particles N, are charged with the same polarity as the corona discharge electrode 2 and accordingly are attracted onto the surface of the drum 1 and rotatably move together with the drum 1. The foreign materials are thus moved to the lowermost position of the drum and accordingly drop into the foreign material collecting hopper 4 due to the force of gravity as designated by an arrow B. Fine foreign materials which remain adhered to the surface of the drum 1 due to their light weight are forcibly scraped off from the drum 1 by the scraper 6.

The conventional electrostatic sorting plant thus described exhibits the following drawbacks in practical use:

(1) Small treatment capacity

As mentioned above, it is necessary, in order to attract the foreign materials onto and remove them from the drum, to charge the foreign materials with ions using a corona discharge. For that purpose, it is necessary to form the foreign materials in a laminar state on the drum to expose them to the corona discharge electrode by limiting the supplying rate of the compost from the feeder. It is necessary to eliminate the superimposition of the foreign materials and the compost on the drum by sufficiently limiting the supplying rate from the feeder so as to evenly distribute the foreign materials on the drum. This results, in the conventional electrostatic sorting plant, in a small sorting capacity per unit length of the rotary drum in the axial direction making it necessary to construct a large plant to achieve a practical processing rate.

(2) Limitations in size and shape of foreign materials to be sorted

As shown in FIG. 2, insulating foreign materials N are moved while adhering to the surface of the drum 1. As to the plastics or film-like chips which are thin and light in weight, however, the distance d from the surface of the chips having a positive charge to the surface of the negatively charged drum is short when the chips are attracted to the surface of the drum so that the resultant electrostatic force is largely exerted between the chips and the surface of the drum and the force of gravity is insufficient to remove them from the surface of the drum even at the lower end of the drum. However, relatively thick ships such as glass have a relatively long isolating distance d therebetween so that the resultant electrostatic force is small. Due to their relatively high weight, they cannot accordingly be attracted onto the drum but immediately slidably drop from the drum into the hopper on the compost side to be thus mixed again with the compost.

SUMMARY OF THE INVENTION

Accordingly, a primary object of the invention is to provide an electrostatic sorting apparatus which eliminates the aforementioned disadvantages and drawbacks of the conventional electrostatic sorting plant, and which enhances the quality of the compost by removing fine foreign materials from the compost after passing through classifying and sorting steps.

Another object of this invention is to provide an electrostatic sorting apparatus which can sort a large capacity of refuse which incorporates a wide range of sizes and shapes of foreign materials.

Yet another object of the invention is to provide an electrostatic sorting apparatus which conducts an agitating effect on the mixture layer upon reciprocation of conductive particles so as to improve the sorting capacity and sorting efficiency thereof.

A further object of the invention is to provide an electrostatic sorting apparatus which eliminates the difficulties of mixing insulating foreign materials with the compost and which can sort and refine pure compost.

Still another object of the invention is to provide an electrostatic sorting apparatus having a compact construction yet with a large sorting capacity.

Still another object of the invention is to provide an electrostatic sorting apparatus which can perform a wide range of applications in refining particles in a variety of fields such as ore, food, medicine and the like in addition to the field of refining compost.

In accordance with these and other objects of the invention, there is provided an electrostatic sorting apparatus including sorting means having a trough-like channel formed on a conveyor belt which is driven substantially horizontally from a supplying position of a mixture to be sorted toward a sorting and recovering position. A high voltage d-c electrode including a corona discharge electrode and a flat electrode is provided with the flat electrode confronting the conveyor belt which forms an opposed electrode. The conveyor belt is at a different potential than the flat electrode and may be grounded. Due to the provision of the high voltage d-c electrode, insulating particles of the mixture are charged with the same polarity as the high voltage electrode means by an ion shower caused by corona discharge to thereby attract the insulating particles into the channel on the conveyor belt. Moreover, the conductive particles of the mixture are charged with the same polarity as the conveyor belt by electrostatic induction to thereby reciprocate the conductive particles between the conveyor belt and the flat electrode of the high voltage electrode by electrostatic force to thereby move the conductive particles out of the channel. The conductive particle and insulating particles are then separately collected at the sorting and recovering position.

If the mixture is constituted with insulating particles which have a larger specific weight than the conductive particles, the corona discharge electrode may be omitted. Further, the conveyor belt of the sorting means can be provided as separate conveyor belts stacked in a vertical arrangement among a plurality of sorting stages. Otherwise, the conveyor belt can be provided as a single conveyor belt laid in a zigzag arrangement through a plurality of stacked sorting stages.

Still further, the conveyor belt can be replaced by a sorting plate which is rotatably driven around a vertical shaft with a trough-like channel being formed circumferentially on the upper central portion of the sorting plate. Preferably, in this embodiment, a plurality of such sorting plate are stacked on a single vertical shaft to provide a multi-stage sorting unit.

The above and other related objects and features of the invention will be apparent from the following description along with the accompanying drawings and the appended claims.

DESCRIPTION OF THE PREFERRED EMBODIMENTS

Figure 1:
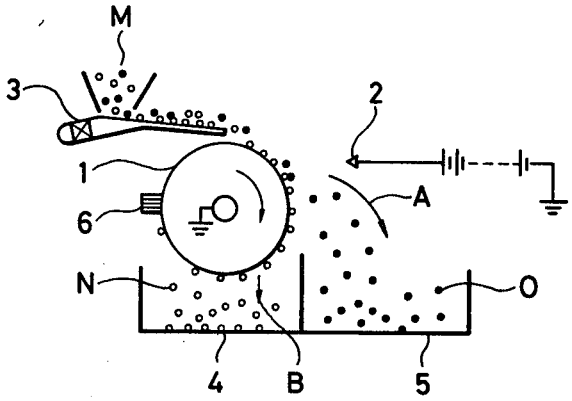
FIG. 1 PRIOR ART
FIG. 1 is a schematic view of a representative conventional electrostatic sorting plant.
Figure 2:
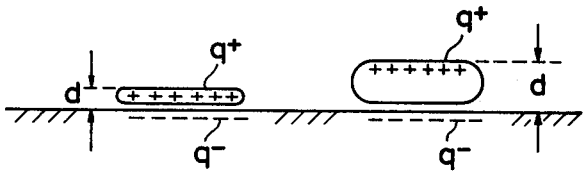
FIG. 2 PRIOR ART
FIG. 2 is a explanatory schematic view of the attracting action of insulating particles in the plant in FIG. 1.
Figure 3:
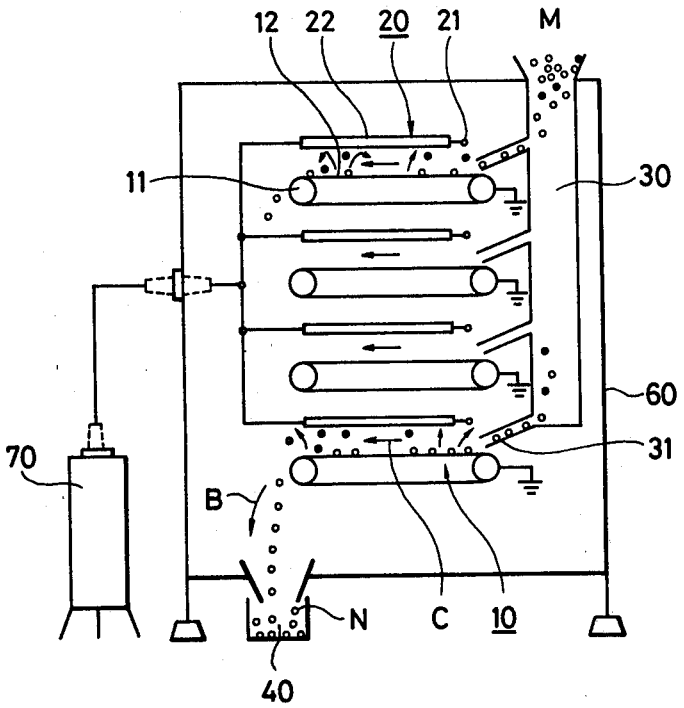
FIG. 3 is a schematic view of the overall configuration of a preferred embodiment of an electrostatic sorting apparatus constructed according to the invention.
Figure 4:
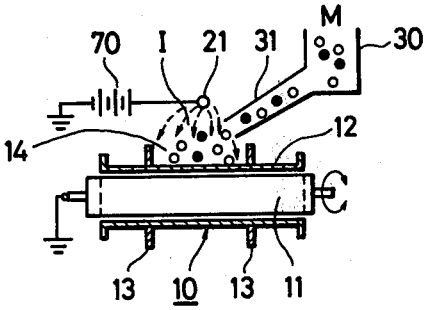
FIGS. 4 through 6 are explanatory views of sorting operations at a mixture supplying end, an intermediate portion and a sorted materials recovering end of a sorting stage in the apparatus shown in FIG. 3.
Figure 5:
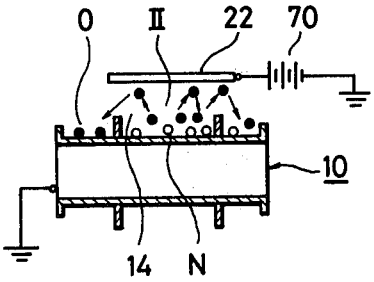
Figure 6:
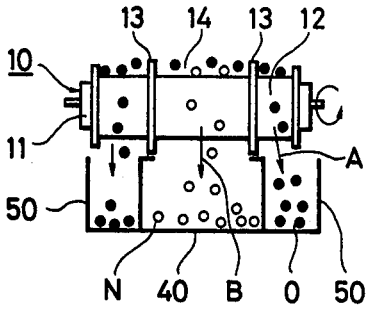
Figure 7:
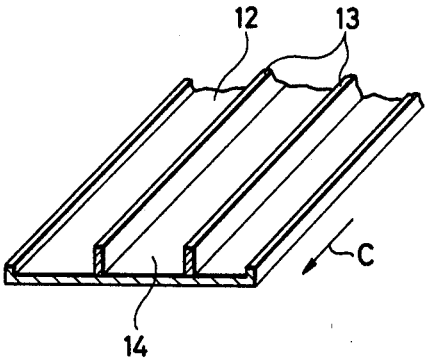
FIG. 7 is a perspective view of the sorting stage used in the apparatus in FIG. 3.

Reference is now made to the drawings, particularly to FIGS. 3 through 7, showing a first preferred embodiment of an electrostatic sorting apparatus constructed according to the invention wherein like reference numerals designate the same parts in the following views. In FIGS. 3 through 7, sorting stages, generally designated by reference numerals 10, which generally correspond to the rotary drum 1 of the conventional electrostatic sorting plant shown in FIG. 1, include a pair of pulleys 11 aligned longitudinally at the front side and at the rear side, and endless conveyor belt 12 laid between the pulleys 11 and left and right partitions 13 formed on the central portion of the belt 12, as shown in FIG. 7, in the direction C of movement of the belt 12 forming a channel 14 of a trough shape therebetween. A plurality of such sorting stages 10 thus formed on the conveyor belt 12 are vertically aligned and arranged as a multi-stage sorting unit. The sorting stages are covered by a housing 60. As shown in FIG. 3, each of the sorting stages 10 has at the right end of the conveyor belt 12 a feeder 30 for supplying mixture M to be sorted and and each has a supply port 31 opening, as shown in FIG. 4, toward the channel 14 and, at the other lower end of the conveyor belt 12, particle sorting and recovering hoppers 40 and 50 located as shown in FIG. 6. Each of the sorting stages 10 also has above the conveyor belt 12 a d-c high voltage electrode 20 confronting the conveyor belt 12 with the conveyor belt 12 being grounded. Each high voltage electrode 20 has a wire-like corona discharge electrode 21, to which high voltage is applied from a high voltage d-c power supply 70, and flat electrode plates 22 with one or more pairs of the corona discharge electrodes 21 and the flat electrode plates 22 sequentially aligned along the direction of movement of the conveyor belts 12.

The operation of the electrostatic sorting stage thus constructed will now be described. When a d-c high voltage is applied to the high voltage electrode 20, the confronting area between the corona discharge electrode 21 and the conveyor belt 12 as well as the confronting area between the flat electrode plate 22 and the conveyor belt 12 become respectively a corona discharge electric field area I and a d-c high voltage strong electric field area II. When the belt conveyor 12 is operated and a mixture M to be sorted, including pure compact with conductive particles O as designated by solid black small circles and insulating particles N as designated by white background small circles, is supplied through the feeder 30 to the channel 14 of the sorting stage 10, the mixture M is first exposed to the corona discharge electric field area I where it is subjected to a strong shower of positive ions as the conveyor belt 12 moves. Since the insulating particles N of the mixture M hold the positive charge for a relatively long time, the particles N are attracted to the conveyor belt 12, which is ground electrode, and are thus retained within the channel 14. On the other hand, the conductive particles O subjected to the ion shower immediately discharge the positive charge to the conveyor belt 12 and are reversely charged with the negative polarity by electrostatic induction action between the particles O and the conveyor belt 12. When the conveyor belt 12 is moved forwardly to bring the mixture toward the strong electric field area II between the belt 12 and the flat electrode plate 22, the particles O having a negative charge are attracted to the flat electrode plates 22 having a positive polarity due to the resulting electrostatic force. When the particles O lose charge due to the discharge caused by the contact with the electrode plate 22, they drop downwardly and are charged with a negative polarity by electrostatic induction. Thus, the particles undergo a cycle of being charged with a negative polarity, being attracted to the flat high voltage electrode, being discharged, and dropping downwardly.

As shown most clearly in FIG. 5, the particles O are vigorously vertically moved between the conveyor belt 12 and the flat electrode plate 22 up and down, eventually passing beyond the partitions 13 and out of the channel 14 toward both the right and left sides to be collected at the side edges of the conveyor belt 12. Further, the mixture M supplied through the feeder 30 in laminar form in the channel 14 is thus agitated in the course of the vertical reciprocating motions of the particles O. Accordingly, particles O which may have been initially buried under the laminar layer are thus exposed on the surface and are consequently exposed directly to the electric field area of the high voltage electrode 20. Thus, all of the particles in the mixture are uniformly affected by the electrostatic sorting action.

When the particles are finally introduced to the end of the belt of the sorting stage 10, the insulating particles N are retained in the channel 14 on the central portion of the belt 12 while the conductive particles O are scattered over the belt out of the channel toward the right and left sides in the state as shown in FIG. 6. Thus, the particles N and O are separately dropped from the end of the belt 12 downwardly and are collected in the particle sorting and recovering hoppers 40 and 50, respectively. It is noted that a scraper, constructed as described with respect to FIG. 1, may suitably be disposed under the conveyor belt 12 if desired to forcibly scrape off particles retained on the belt 12.

The same sorting operation is carried out in each of the respective sorting stages. Since the sorting apparatus of the invention employs a plurality of sorting stages within the cover housing 60 aligned vertically in a multi-stage sorting unit as depicted in FIG. 3, the space within the housing 60 is effectively utilized to provide a sorting apparatus providing a high sorting capacity in a compact construction.

Figure 8:
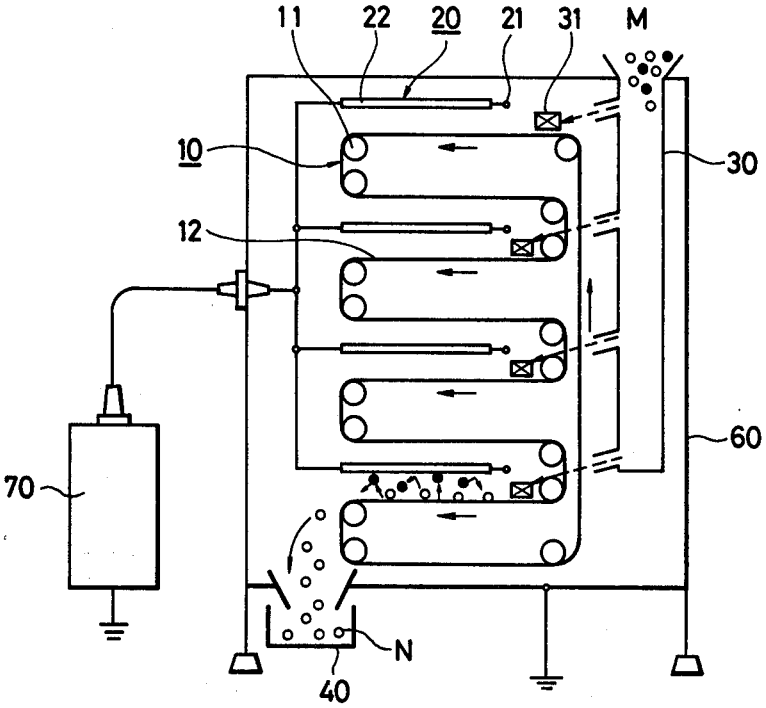
FIG. 8 is a schematic view of a second preferred embodiment of an electrostatic sorting apparatus constructed according to the invention.

Referring now to FIG. 8, which shows another preferred embodiment of an electrostatic sorting apparatus constructed according to the invention, the sorting apparatus of this embodiment employs a plurality of sorting stages vertically aligned within the cover housing 60 in a multi-stage sorting unit in the same manner as that shown in FIG. 3. However, only a single belt conveyor is used, the belt extending through the plural sorting stages. More particularly, one long endless conveyor belt 12 is, as shown, laid in a zigzag manner through the four vertically-aligned sorting stages. A high voltage electrode 20 confronts each of the sorting stages, and a mixture supply feeder 30 having a supply port 31 opening toward a trough-like channel (not shown) is provided at the right side of the sorting stages in the same manner as in the apparatus shown in FIG. 3. The sorting operation of the sorting stages thus constructed is carried out in the same manner as in the embodiment shown in FIG. 3.

In case that insulating particles N in the mixture M have a larger specific weight than the conductive particles O, the corona discharge electrode 21 may be omitted and only the flat electrode plate 22 need be employed as the high voltage electrode. Since particles N having a larger specific weight than conductive particles O cannot pass out of the channel along the electric field line, the conductive particles O and the insulating particles N are sorted in the same manner as in the previously-described embodiment shown in FIG. 3 so as to provide an improved sorting capacity and sorting efficiency in the same manner as that of the embodiment shown in FIG. 3.

As described above, the electrostatic sorting apparatus of the invention includes a flat conveyor belt which extends and moves substantially horizontally from the supply position of a mixture to be sorted toward a sorting and recovering end. At least one sorting stage includes a trough-like channel on the upper surface of the conveyor belt extending in the direction of movement of the conveyor. A d-c high voltage electrode has in combination a corona discharge electrode which confront the conveyor belt, which acts as an opposite electrode, and a flat electrode plate. The mixture to be sorted is supplied from the supply end into trough-like channels formed on the conveyor belt 12 thereby moving insulating particles charged with the same polarity as the high voltage electrode upon exposure to an ion shower caused by the corona discharge of the mixture toward the sorting and recovering end and into collecting channels. The conductive particles are expelled from the channels by electrostatic induction while being reciprocated between the conveyor belt and the flat high voltage electrode by electrostatic force. The conductive and the insulating particles of the mixture are accordingly sorted. The sorting capacity and sorting efficiency of the sorting apparatus of the invention are enhanced by the agitating effect on the mixture layer upon reciprocation of the conductive particles. It should also be appreciated that in the electrostatic sorting apparatus of the invention thus constructed only conductive particles of the mixture pass over the channels toward the right and left side of the conveyor belt and are sorted by means of electrostatic force. Hence, there is no difficulty if insulating foreign materials are mixed in the compost as the apparatus of the invention can still sort and refine the pure compost. It should also be understood that since the sorting apparatus of the invention employs a plurality of sorting stages in a multi-stage sorting unit aligned vertically, the space within the housing in which the sorting unit is mounted is efficiently used and a sorting apparatus having a high sorting capacity is provided with a compact construction. It should be noted that the sorting apparatus of the invention can also be used in other applications in refining particles in a variety of fields such as ore refining, food preparation, medicine and the like in addition to the field of refining compost.

Figure 9:
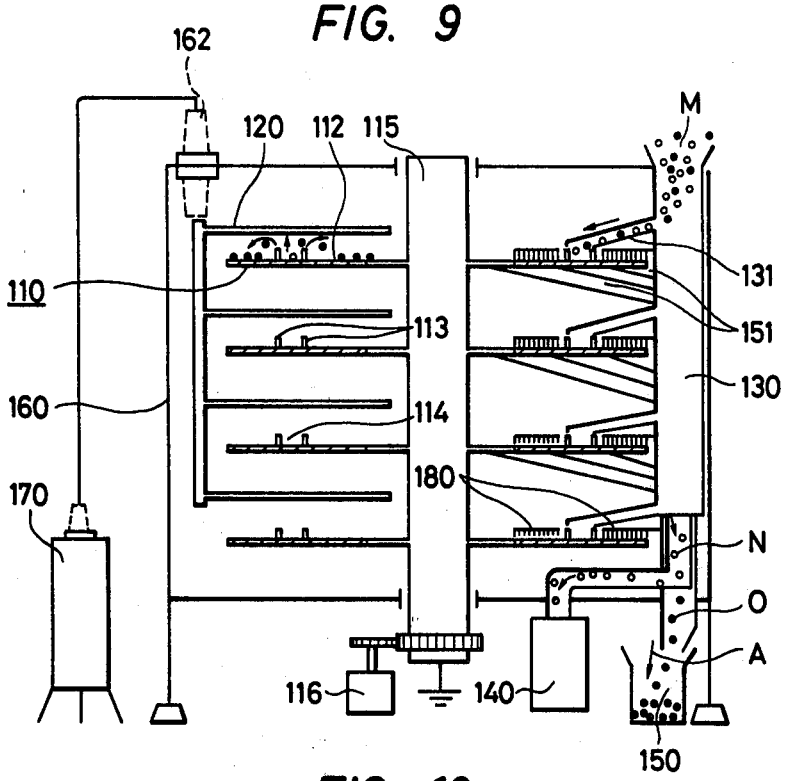
FIGS. 9 and 10 are side and plan views of a third preferred embodiment of the sorting apparatus constructed according to the invention.
Figure 10:
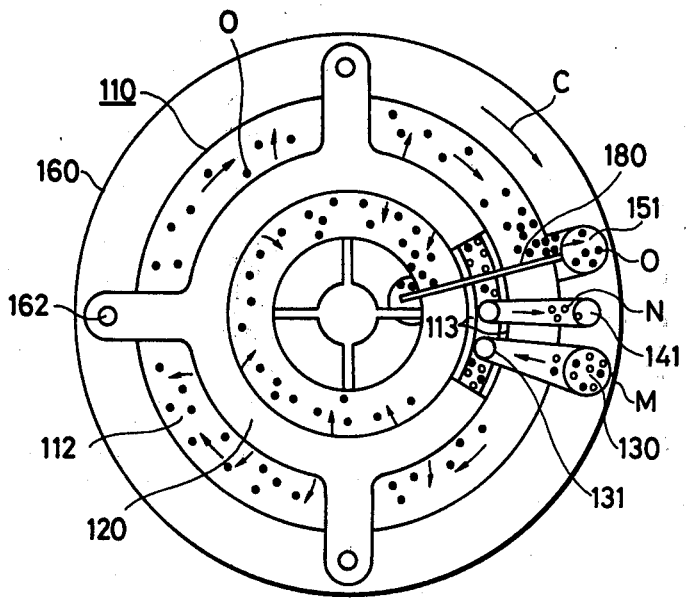

Reference is now made to FIGS. 9 and 10 which show still another preferred embodiment of an electrostatic sorting apparatus constructed according to the invention. In FIGS. 9 and 10, a sorting stage, generally designated by reference numeral 110, corresponds to the rotary drum 1 of the conventional electrostatic sorting plant shown in FIG. 1. The sorting stage includes a disc-shaped sorting plate 112 and inner and outer partitions 113 formed on the central portion of the sorting plate 112 along the peripheral direction to form a channel 114.

Figure 11:
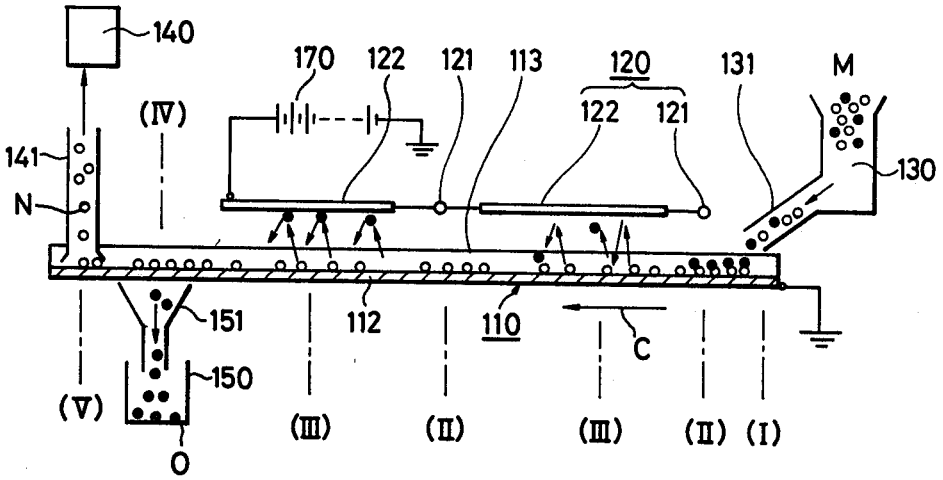
FIG. 11 is a developed view of the sorting stage in the circumferential direction used to explain the sorting operation of the sorting apparatus of the invention as shown in FIGS. 9 and 10.

A plurality of such sorting stages 110 thus constructed are vertically aligned upon a rotary shaft 115 of a vertical shaft. The respective sorting stages 110 are slowly rotated together with the rotary shaft 115 through a reduction gear mechanism by a drive motor 116 in a direction designated by an arrow C. Further, a supply position and sorting and recovering positions of a mixture to be sorted are respectively determined for each of the sorting plates 112 in the respective sorting stages 110. Each of the sorting stages 110 also includes above the sorting plate 112 a d-c high voltage electrode 120 confronting the sorting plate 112, which is grounded, in the peripheral area between both the two. The high voltage electrode 120 has, as shown in FIG. 11, pairs of slender wire-like corona discharge electrodes 121 to which high voltage is applied from a high voltage d-c power supply, which will be described hereinafter in greater detail, and a flat electrode plate 122 with a set of or a plurality of sets of the corona discharge electrodes 121 and the flat electrode plates 122 being sequentially aligned alternately along the direction of rotation C of the sorting stages 110. Each of the sorting stages 110 incorporates at the supply position of the mixture a feeder 130 for supplying the mixture M to be sorted having a supply port 131 opening toward the channel 114, and at the sorting and recovering position a recovering hopper 140 for insulating particles N, an intake tube 141 connected to the hopper 140 opening toward the channel 114 over the sorting plate 112, a recovering hopper 150 for conductive particles O located at the side of the inner and the outer peripheries of the sorting plate 112, and a guide tube 151 connected to the hopper 150 and opening below the sorting plate 112. Reference numeral 180 depicts a scraper which serves to scrape off conductive particles O moving irregularly on the inner and the outer peripheries of the sorting plate 110 toward the hopper 150. An assembly of the aforementioned multi-stage sorting stages thus constructed is positioned in a cover housing 160. The high voltage electrode 20 is connected through a bushing 161 mounted at the housing 160 to the high voltage d-c power supply 170.

Figure 12:
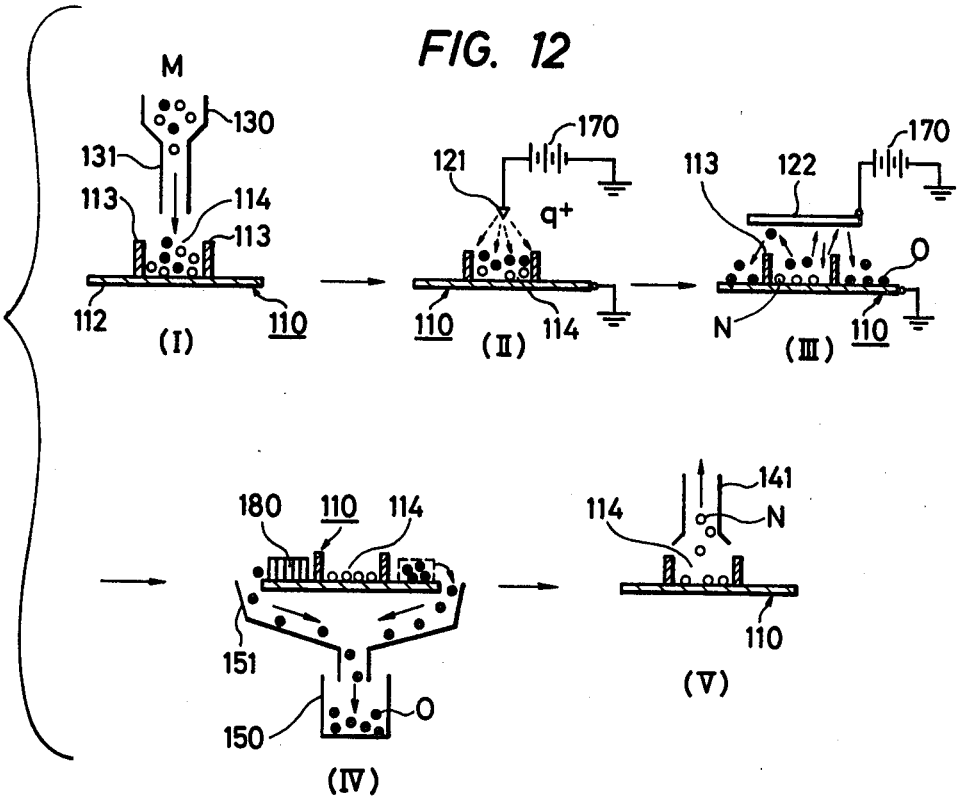
FIGS. 12(I) through 12(V) are cross-sectional views of sorting operations in circumferential and perpendicular directions in accordance with the sections designated by (I) through (V) in FIG. 11.

The sorting unit thus fabricated is shown in a cross-sectional view in FIG. 11 and respective portions as designated by (I) through (V) indicated in FIG. 11 are shown in a cross-sectional view in FIG. 12 taken perpendicularly to the view of FIG. 11.

The operation of the electrostatic sorting stage thus constructed will now be described with reference to FIGS. 11 and 12. When a d-c voltage is applied from the high voltage d-c power supply 170 to the high voltage electrode 120, a corona discharge electric field area is formed between the high voltage electrode 120 and the grounded sorting plates 112 directly under the corona discharge electrodes 121. A strong electric field area is formed therebetween directly under the flat electrode plate 122. When the sorting stage 110 is rotated in this state in a direction designated by an arrow C and a mixture M to be sorted of conductive particles O (pure compost) and of insulating particles N (foreign materials) is supplied from the supply feeder 130 into the channel 114 at the supply end designated by (I), the mixture M is introduced first into the corona discharge electric field area designated by (II) as the sorting stage 110 is rotated. Then, the mixture M is exposed with a strong positive ion shower from the corona discharge electrode 121 and is charged with a positive charge $q^+$. Since the insulating particles N, as designated by white background small circles retain the positive charge for a relatively long time, the particles N are attracted to the sorting plate 112, which is at a negative polarity and are thus are retained within the channel 114 in the course of rotary movement. On the other hand, the conductive particles O, as designated by solid black small circles, are discharged to the sorting plate 112, and are reversely charged with a negative polarity due to electrostatic induction. When the sorting plate 112 further rotates to cause the mixture to enter the strong electric field area designated by (III), the insulating particles N are retained attracted to the channel 114 while the conductive particles O are repelled from the sorting plate 112 by the electrostatic force generated by the electric field and collide with the flat electrode plate 122 at the positive polarity. Further, the conductive particles O make contact with the electrode plate 122 and accordingly lose their charge and consequently drop downwardly. They are charged again with a negative polarity by electrostatic induction. Thus, the particles undergo a repeated cycle of being charged with a negative polarity, being attracted to the flat high voltage electrode plate being discharged, and dropping downwardly. As most clearly shown at the position designated by (III) in FIG. 12, the particles, are vigorously vertically moved between the sorting plate 112 and the flat electrode plate 122 up and down, eventually pass over the partitions 113 out of the channel 114 toward both the right and left sides. When they pass beyond the edges of the plates 112, they are collected.

Simultaneously, the mixture M supplied in laminar form in the channel 114 is accordingly agitated by the vertical up and down motions of the particles. Consequently, particles initially buried under the laminar layer are brought to the surface and are thus exposed directly to the corona discharge electric field area designated by (II) and the strong electric field designated by (III). Therefore, all of the particles are uniformly affected by the electrostatic sorting action. As the sorting plates 112 further rotate and the mixture is finally brought to the sorting and recovering position, the insulating particles N are retained in the channel 114 on the central portion of the sorting plate 112 while the conductive particles O are scattered and sorted over the inner and the outer peripheral areas out of the channels 114. The conductive particles O are scraped off from the recovering position designated by (IV) by the scraper 180 to thus be recovered in the recovering hopper 150 while the insulating particles N are attracted and recovered in the recovering hopper 140 using, for example, a bag filter at the recovering position designated by (V). Such a sorting operation is conducted in each of the sorting stages in this embodiment of the sorting apparatus.

If the insulating particles N in the mixture M all have a larger specific weight than the conductive particles O, the corona discharge electrode 121 may be omitted and only the flat electrode plate 122 need be employed as the high voltage electrode. Since the particles N having larger specific weight than the particles O cannot then pass over the channel, the conductive particles O and the insulating particles N are thus sorted in the same manner as in the previously-described embodiments shown in FIGS. 3 and 8.

As described above, the electrostatic sorting apparatus of this embodiment includes sorting plates with trough-like channels formed thereon with the plates rotatably driven by a vertical shaft. A high voltage electrode confronts each sorting plate. The mixture to be sorted is supplied from the supply position into the trough-like channel. Particle recovering hoppers are provided at the sorting and recovering positions located at the inside and the outside of the trough-like channels. Insulating particles of the mixture to be sorted are retained in the channel and only the conductive particles are moved reciprocating between the sorting stage and the high voltage electrode due to the electrostatic forces thereon. Thus, the particles are sorted by the conductive particles passing out of the channel. The sorting capacity and sorting efficiency of the apparatus are enhanced by the agitating effect of the mixture upon reciprocation of the conductive particles. It should further be appreciated that in the electrostatic sorting apparatus of this embodiment of the invention thus constructed, only the conductive particles of the mixture pass over the channel toward the outside. Hence, there is no difficulty if insulating foreign materials are mixed in the compost as the apparatus of the invention can still sort and refine the pure compost. It should also be understood that since the sorting apparatus of this embodiment of the invention employs a plurality of sorting stages in a multi-stage sorting unit aligned vertically, the space within the housing in which the apparatus is mounted is effectively used and a sorting apparatus having a high sorting capacity is provided with compact construction. It should be noted that the sorting apparatus of this embodiment of the invention can also be used in other applications in refining particles in a variety of fields such as ore refining, food preparation, medicine and the like in addition to the field of refining compost.

What is claimed is:

1. An electrostatic sorting apparatus comprising:

sorting means comprising a trough-like channel formed on the upper surface of a horizontal conveyor member, said conveyor member being driven from a supplying position of a mixture to be sorted toward a sorting and recovering position;

high voltage d-c electrode means comprising a corona discharge electrode and a flat electrode, said flat electrode confronting said conveyor member, said conveyor member forming an opposed electrode with said flat electrode and said conveyor member being at a different potential than said flat electrode, wherein insulating particles of said mixture are charged with the same polarity as said high voltage electrode means by means of an ion shower caused by said corona discharge electrode to attract said insulating particles into said channel of said sorting means, and wherein conductive particles of said mixture are charged with the same polarity as said conveyor member by electrostatic induction to reciprocate said conductive particles between said conveyor belt and said flat electrode of said high voltage electrode by electrostatic force to thereby move said conductive particles out of said channel;

mixture supplying means for supplying said mixture to said channel of said sorting means; and means for separately collecting conductive particles and insulating particles sorted from said mixture.

2. The electrostatic sorting apparatus as claimed in claim 1, wherein said sorting means comprises a plurality of partitions formed on a central portion of said conveyor member to form said trough-like channel.

3. The electrostatic sorting apparatus as claimed in claim 1, wherein said sorting means comprises a plurality of sorting stages arranged substantially vertically in a multi-stage sorting unit, and said high voltage d-c electrode means comprises a plurality of high voltage electrode plates confronting respective ones of said conveyor members.

4. The electrostatic sorting apparatus as claimed in claim 3, wherein said multi-stage sorting unit comprises a plurality of independent belt conveyors each having a trough-like channel.

5. The electrostatic sorting apparatus as claimed in claim 3, wherein said multi-stage sorting unit comprises an endless conveyor belt having a plurality of horizontally disposed portions located one above the other to define said plurality of sorting stages.

6. An electrostatic sorting apparatus comprising:

sorting means comprising a trough-like channel formed on a substantially horizontal conveyor member, said conveyor member being driven from a supplying position of a mixture to be sorted toward a sorting and recovering position, said mixture comprising conductive particles and insulating particles, said insulating particles having a larger specific weight than said conductive particles;

a high voltage d-c electrode comprising a flat electrode confronting said conveyor member, said conveyor member forming an opposed electrode with said flat electrode and being at a different potential than said flat electrode, wherein said insulating particles of said mixture remain in said channel of said sorting means, and wherein said conductive particles of said mixture are charged with the same polarity as said conveyor member by electrostatic induction to reciprocate said conductive particles between said conveyor member and said flat electrode of said high voltage electrode by electrostatic force to thereby move said particles out of said channel;

mixture supplying means for supplying said mixture to the said channel of said sorting means; and means for separately collecting said conductive particles and said insulating particles sorted from said mixture.

7. An electrostatic sorting apparatus comprising:

sorting means comprising a conveyor plate rotatably driven in a predetermined direction around a vertical shaft, a trough-like channel being circumferentially formed on an upper channel portion of said sorting plate;

high voltage d-c electrode means comprising in combination a corona discharge electrode and a flat electrode, said flat electrode plate confronting said conveyor plate in a circumferential area on an upper surface of said conveyor plate of said sorting means between a mixture supplying position and mixture recovering position, wherein insulating particles of said mixture are charged with the same polarity as said high voltage electrode means by means of an ion shower caused by said corona discharge electrode to attract said insulating particles into said channel of said sorting means, and wherein conductive particles of said mixture are charged with the same polarity as said sorting means by electrostatic induction to reciprocate said conductive particles between said conveyor plate and said flat electrode of said high voltage electrode by electrostatic force;

mixture supply feeder means at said supplying position for supplying a mixture of insulating and conductive particles to said channel of said sorting means; and an insulating particle recovering hopper means at said recovering position for recovering particles from said channel and a conductive particle recovering hopper means at said recovery portion for recovering particles outside said channel of said sorting means.

8. The electrostatic sorting apparatus as claimed in claim 7, wherein said sorting means comprises a plurality of horizontally disposed conveyor plates arranged coaxially and vertically as a multi-stage sorting unit, and said high voltage d-c electrode means comprises a plurality of high voltage electrode plates confronting respective ones of said conveyor plates.

9. The electrostatic sorting apparatus as claimed in claim 7 or 8, wherein said sorting means comprises a plurality of partitions formed on the upper portion of each conveyor plate with a trough-like channel being formed between said partitions.

10. The electrostatic sorting apparatus as claimed in claim 8, wherein said sorting means further comprises a scraper for scraping conductive particles of said mixture from inner and outer peripheral portions of said sorting plate outside said channel toward said conductive particle recovery hopper.

11. An electrostatic sorting apparatus comprising:

sorting means comprising a conveyor plate rotatably driven in a predetermined direction around a vertical shaft, an annular trough-like channel being formed on an upper central portion of said sorting plate;

high voltage d-c electrode means comprising a flat electrode plate disposed opposite said channel between a mixture supplying position and a mixture recovering position, supply means for supplying a mixture of insulating and conductive particles with said insulating particles having a larger specific weight than said conductive particles, so that said conductive particles of said mixture are charged with the same polarity as said conveyor plate by electrostatic induction to reciprocate said conductive particles between said sorting plate and said flat electrode of said high voltage electrode by electrostatic force; and means for separately collecting conductive particles and insulating particles sorted from said mixture.

* * * * *